US008033658B2

(12) United States Patent
Kachi

(10) Patent No.: US 8,033,658 B2
(45) Date of Patent: Oct. 11, 2011

(54) LIQUID EJECTION APPARATUS AND LIQUID RESTORATION METHOD

(75) Inventor: Yasuhiko Kachi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 940 days.

(21) Appl. No.: 11/706,195

(22) Filed: Feb. 15, 2007

(65) Prior Publication Data

US 2007/0195142 A1 Aug. 23, 2007

(30) Foreign Application Priority Data

Feb. 17, 2006 (JP) ..... 2006-041462

(51) Int. Cl.
*B41J 2/19* (2006.01)

(52) U.S. Cl. ..... 347/92

(58) Field of Classification Search ..... None
See application file for complete search history.

(56) References Cited

U.S. PATENT DOCUMENTS

| | | | | |
|---|---|---|---|---|
| 5,745,132 | A | 4/1998 | Hirabayashi et al. | |
| 5,751,304 | A | 5/1998 | Hirabayashi et al. | |
| 6,116,709 | A | 9/2000 | Hirabayashi et al. | |
| 6,139,125 | A | 10/2000 | Otsuka et al. | |
| 6,193,344 | B1 | 2/2001 | Otsuka et al. | |
| 2005/0185010 | A1 * | 8/2005 | Kojima | 347/17 |
| 2008/0278558 | A1 | 11/2008 | Kojima | |

FOREIGN PATENT DOCUMENTS

| | | | | |
|---|---|---|---|---|
| JP | 5-31906 | A | | 2/1993 |
| JP | 2000-190529 | A | | 7/2000 |
| JP | 2004-181890 | A | | 7/2004 |
| JP | 2004181830 | A | * | 7/2004 |
| JP | 2005-262876 | A | | 9/2005 |
| JP | 2005262876 | A | * | 9/2005 |

OTHER PUBLICATIONS

Office Action dated Dec. 15, 2010 for Japanese Application No. 2006-041462.

Office Action dated Jun. 15, 2011 for corresponding Japanese Application No. 2006-041462.

* cited by examiner

*Primary Examiner* — Stephen Meier
*Assistant Examiner* — Alexander C Witkowski
(74) *Attorney, Agent, or Firm* — Birch, Stewart, Kolasch & Birch, LLP

(57) ABSTRACT

The liquid ejection apparatus includes: a liquid ejection device which ejects liquid; a liquid supply device which supplies the liquid to the liquid ejection device; a saturated dissolved gas amount determination device which determines a saturated dissolved gas amount of the liquid in the liquid ejection device; a dissolved gas amount determination device which determines a dissolved gas amount of the liquid in the liquid ejection device; a liquid restoration device which carries out a liquid restoration processing to reduce the dissolved gas amount of the liquid inside the liquid ejection device; and a liquid restoration control device which controls whether or not the liquid restoration device carries out the liquid restoration processing, according to a differential between the saturated dissolved gas amount determined by the saturated dissolved gas amount determination device and the dissolved gas amount determined by the dissolved gas amount determination device.

13 Claims, 14 Drawing Sheets

FIG.14

| GAS DISSOLVING CAPACITY OF EJECTION LIQUID A-B(mg/l) | EJECTION STATE (GAS BUBBLE DISSOLUTION STATE) |
|---|---|
| 3.5mg/l | GOOD |
| 1.5mg/l | GOOD |
| 0.5mg/l | POOR |

A: SATURATED AMOUNT OF DISSOLVED OXYGEN OF EJECTION LIQUID(mg/l)
B: AMOUNT OF DISSOLVED OXYGEN IN EJECTION LIQUID (mg/l)

LIQUID EJECTION APPARATUS AND LIQUID RESTORATION METHOD

BACKGROUND OF THE INVENTION

1. Field of the Invention

The present invention relates to a liquid ejection apparatus and a liquid restoration method, and more particularly, to a liquid ejection apparatus and a liquid restoration method whereby the amount of dissolved gas in the liquid can be controlled and the liquid can be maintained in a desirable state.

2. Description of the Related Art

In recent years, inkjet printers have become widespread. An inkjet printer forms an image on an ejection receiving medium, such as paper, by ejecting ink from nozzles onto the ejection receiving medium. Furthermore, inkjet heads are known as ejection devices for ejecting ink, and such inkjet heads include, for example, an inkjet head which uses a so-called piezoelectric type of actuator for applying a pressure wave to ink inside a pressure chamber connected to a nozzle, an inkjet head which uses a so-called thermal jet type of actuator for generating a bubble by heating ink inside the pressure chamber, and the like. Ink is ejected from nozzles by operating ejection devices described above, thereby forming an image on the ejection receiving medium.

In an inkjet printer of this kind, if an undesired air bubble is generated unintentionally in the ink inside the inkjet head, then there is a loss in the pressure applied by the actuator to the ink, and ejection abnormalities such as ink ejection volume abnormalities, ejection direction abnormalities, ejection failures, and the like, may occur. Ejection abnormalities of this kind cause a marked decline in image quality.

Japanese Patent Application Publication No. 2000-190529 discloses a method in which the amount of gas dissolved in liquid that has been expelled without being ejected from the inkjet head is measured, and the amount of dissolved gas in the liquid inside the inkjet head is controlled in such a manner that the measured amount of dissolved gas in the liquid in the inkjet head becomes equal to or less than a prescribed value. More specifically, if the measured value of the amount of dissolved gas in the liquid expelled from the inkjet head exceeds the prescribed value, then the supply of liquid to the inkjet head is halted, the dissolved gas in the liquid inside the tank is removed, and the liquid in the tank is then supplied to the inkjet head.

However, when the saturated amount of dissolved gas in the ink varies with environmental changes (in particular, temperature changes) of the inkjet head and the ink supply system, then the differential (which corresponds to the gas dissolving capacity) between the saturated amount of dissolved gas and the actual amount of dissolved gas changes, accordingly. In other words, the tendency of the dissolved gas contained in the ink to be ejected from the inkjet head to form gas bubbles depends on variation in the ink temperature, and the like.

Therefore, even if the amount of dissolved gas in the ink inside the inkjet head is controlled by using a deaerator, or the like, in such a manner that the amount of dissolved gas in the ink inside the inkjet head does not exceed the prescribed value, there is a possibility that gas dissolved in the ink in the inkjet head might form gas bubbles in cases where the ink temperature rises after the inkjet printer starts operation. This leads to giving rise to loss of ejection pressure, which may cause ejection abnormalities, such as ejection failures, or the like.

Moreover, printing needs to be interrupted and the dissolved gas needs to be removed by using a deaerator, or the like, when the amount of dissolved gas is greater than the prescribed value. Therefore, printing cannot be carried out until the amount of dissolved gas becomes equal to or lower than the prescribed value, and hence wasteful waiting time arises.

SUMMARY OF THE INVENTION

The present invention has been contrived in view of the foregoing circumstances, an object thereof being to provide a liquid ejection apparatus and a liquid restoration method whereby the occurrence of ejection abnormalities caused by the formation of bubbles of dissolved gas can be reduced in a reliable fashion even if there is variation in the liquid temperature.

In order to attain the aforementioned object, the present invention is directed to a liquid ejection apparatus, comprising: a liquid ejection device which ejects liquid; a liquid supply device which supplies the liquid to the liquid ejection device; a saturated dissolved gas amount determination device which determines a saturated dissolved gas amount of the liquid in the liquid ejection device; a dissolved gas amount determination device which determines a dissolved gas amount of the liquid in the liquid ejection device; a liquid restoration device which carries out a liquid restoration processing to reduce the dissolved gas amount of the liquid inside the liquid ejection device; and a liquid restoration control device which controls whether or not the liquid restoration device carries out the liquid restoration processing, according to a differential between the saturated dissolved gas amount determined by the saturated dissolved gas amount determination device and the dissolved gas amount determined by the dissolved gas amount determination device.

According to this aspect of the present invention, whether or not to implement the liquid restoration processing in order to reduce the amount of dissolved gas in the liquid ejection device is controlled in accordance with the differential between the saturated amount of dissolved gas of the liquid inside the liquid ejection device determined by the saturated dissolved gas amount determination device and the amount of dissolved gas in the liquid ejection device measured by the dissolved gas amount determination device. Hence, the liquid restoration processing is carried out on the basis of the liability of the dissolved gas to form gas bubbles. Accordingly, it is possible to reliably reduce the occurrence of ejection abnormalities due to formation of gas bubbles of the dissolved gas, even if there is a variation in the saturated amount of dissolved gas of the liquid inside the liquid ejection device due to environmental changes, such as variation in the liquid temperature.

Preferably, the saturated dissolved gas amount determination device determines the saturated dissolved gas amount according to at least one of a temperature of the liquid in the liquid ejection device, a temperature of the liquid in the liquid supply device, a temperature of the liquid ejection device, and a temperature of the liquid supply device.

According to this aspect of the present invention, the saturated amount of dissolved gas of the liquid inside the liquid ejection device can be determined directly on the basis of the liquid temperature inside the liquid ejection device, or it can be determined indirectly on the basis of the liquid temperature inside the liquid supply device, the temperature of the liquid ejection device, or the temperature of the liquid supply device. Thus, the saturated amount of dissolved gas of the liquid inside the liquid ejection device is determined on the basis of a temperature relating to the liquid inside the liquid ejection device.

Preferably, the dissolved gas amount determination device measures a dissolved gas amount of the liquid in one of the liquid ejection device and the liquid supply device, and determines the dissolved gas amount of the liquid in the liquid ejection device according to the measured dissolved gas amount of the liquid.

According to this aspect of the present invention, the amount of dissolved gas in the liquid inside the liquid ejection device is either determined directly inside the liquid ejection device or determined indirectly inside the liquid supply device. Thus, an amount of dissolved gas relating to the liquid inside the liquid ejection device is determined.

Preferably, the saturated dissolved gas amount determination device determines the saturated dissolved gas amount according to both of a pressure and a temperature of the liquid in the liquid ejection device.

According to this aspect of the present invention, if there is a change in the pressure inside the liquid ejection device, then the saturated amount of dissolved gas is determined in accordance with both of the liquid pressure inside the liquid ejection device and the liquid temperature inside the liquid ejection device.

Preferably, the saturated dissolved gas amount determination device: estimates a maximum temperature of the liquid in the liquid ejection device which may occur during subsequent use, according to a temperature change history relating to the liquid in the liquid ejection device within a prescribed time period which has passed; and determines the saturated dissolved gas amount according to the maximum temperature of the liquid in the liquid ejection device.

The temperature change history may be any one of: the history of temperature change in the liquid in the liquid ejection device; the history of temperature change in the liquid inside the liquid supply device; the history of temperature change in the liquid ejection device; and the history of temperature change in the liquid supply device, provided that the temperature change history is relevant to the liquid in the liquid ejection device. In cases where environmental conditions greatly depend on the temperature of the air, it is also possible to use the history of change in the air temperature.

According to this aspect of the present invention, the liability of formation of gas bubbles during the current use can be predicted on the basis of the history of temperature change relating to the liquid inside the liquid ejection device.

Preferably, the saturated dissolved gas amount determination device: selects a maximum differential from temperature differentials between temperatures of the liquid in the liquid ejection device at past startups of the liquid ejection apparatus and maximum temperatures of the liquid in the liquid ejection device during use after the past startups; estimates a maximum temperature of the liquid in the liquid ejection device which may occur during use after a current startup by adding the maximum differential to a temperature of the liquid in the liquid ejection device at the current startup of the liquid ejection apparatus; and determines the saturated dissolved gas amount according to the estimated maximum temperature of the liquid in the liquid ejection device.

According to this aspect of the present invention, even if the amount of the temperature increase changes with the season in which the apparatus is used, it is still possible to accurately predict the liability to form gas bubbles when the apparatus is switched on, or the like.

Preferably, the saturated dissolved gas amount determination device determines the saturated dissolved gas amount according to a maximum temperature of the liquid in the liquid ejection device during the prescribed time period which has passed.

According to this aspect of the present invention, the liability to form gas bubbles can be predicted simply.

Preferably, the liquid restoration control device controls the liquid restoration device in such a manner that the liquid restoration device carries out the liquid restoration processing if the differential between the saturated dissolved gas amount and the dissolved gas amount at a startup of the liquid ejection apparatus is less than a prescribed value.

According to this aspect of the present invention, it is possible to restore the liquid state prior to a printing operation, and it is also possible to restore the liquid state only in cases where there is a possibility of gas bubbles forming during the current use. Hence, it is possible to prevent the excessive occurrence of suspension of printing due to the liquid restoration processing being carried out during printing, and it is also possible to minimize the implementation of liquid restoration processing at startup.

Preferably, the liquid ejection apparatus further comprises: a liquid circulation channel which is provided between the liquid ejection device and the liquid supply device, and leads the liquid in the liquid ejection device which has not been ejected, to the liquid supply device; and a liquid sending device which is provided in the liquid circulation channel, and sends the liquid in the liquid ejection device to the liquid supply device, wherein the liquid restoration control device controls the liquid sending device in such a manner that the liquid sending device sends the liquid in the liquid ejection device to the liquid supply device if the differential between the saturated dissolved gas amount and the dissolved gas amount is less than a prescribed value.

Preferably, the liquid ejection apparatus further comprises: a liquid circulation channel which is provided between the liquid ejection device and the liquid supply device, and leads the liquid in the liquid ejection device which has not been ejected, to the liquid supply device; and a deaerator which is provided in the liquid circulation channel, and removes dissolved gas from the liquid in the liquid circulation channel, wherein the liquid restoration control device controls the deaerator in such a manner that the deaerator removes the dissolved gas from the liquid in the liquid circulation channel if the differential between the saturated dissolved gas amount and the dissolved gas amount is less than a prescribed value.

In order to attain the aforementioned object, the present invention is also directed to a liquid restoration method for restoring a state of liquid in a liquid ejection device, the liquid restoration method including the steps of: determining a saturated dissolved gas amount of the liquid in the liquid ejection device; determining a dissolved gas amount of the liquid in the liquid ejection device; conducting judgment of whether or not to carry out a liquid restoration processing for reducing the dissolved gas amount of the liquid, according to a differential between the saturated dissolved gas amount and the dissolved gas amount; and carrying out the liquid restoration processing in accordance with result of the conducted judgment.

Preferably, the liquid restoration method further includes the step of obtaining a temperature of the liquid in the liquid ejection device, wherein the saturated dissolved gas amount is determined according to the temperature of the liquid in the liquid ejection device.

Preferably, the liquid restoration method further includes the step of estimating a maximum temperature of the liquid in the liquid ejection device which may occur during subsequent use, according to a temperature change history relating to the liquid in the liquid ejection device within a prescribed time period which has passed, wherein the saturated dissolved gas amount is determined according to the maximum temperature of the liquid.

According to the present invention, even if there is variation in the liquid temperature, it is possible to reliably reduce the occurrence of ejection abnormalities caused by the formation of gas bubbles of the dissolved gas.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 14 is an illustrative diagram showing experimental results relating to the relationship between the gas bubble dissolution capacity (A–B; "A" is a saturated amount of dissolved gas, and "B" is an amount of dissolved gas) of the ejection liquid, and the ejection state.

DETAILED DESCRIPTION OF THE PREFERRED EMBODIMENTS

Figure 1:
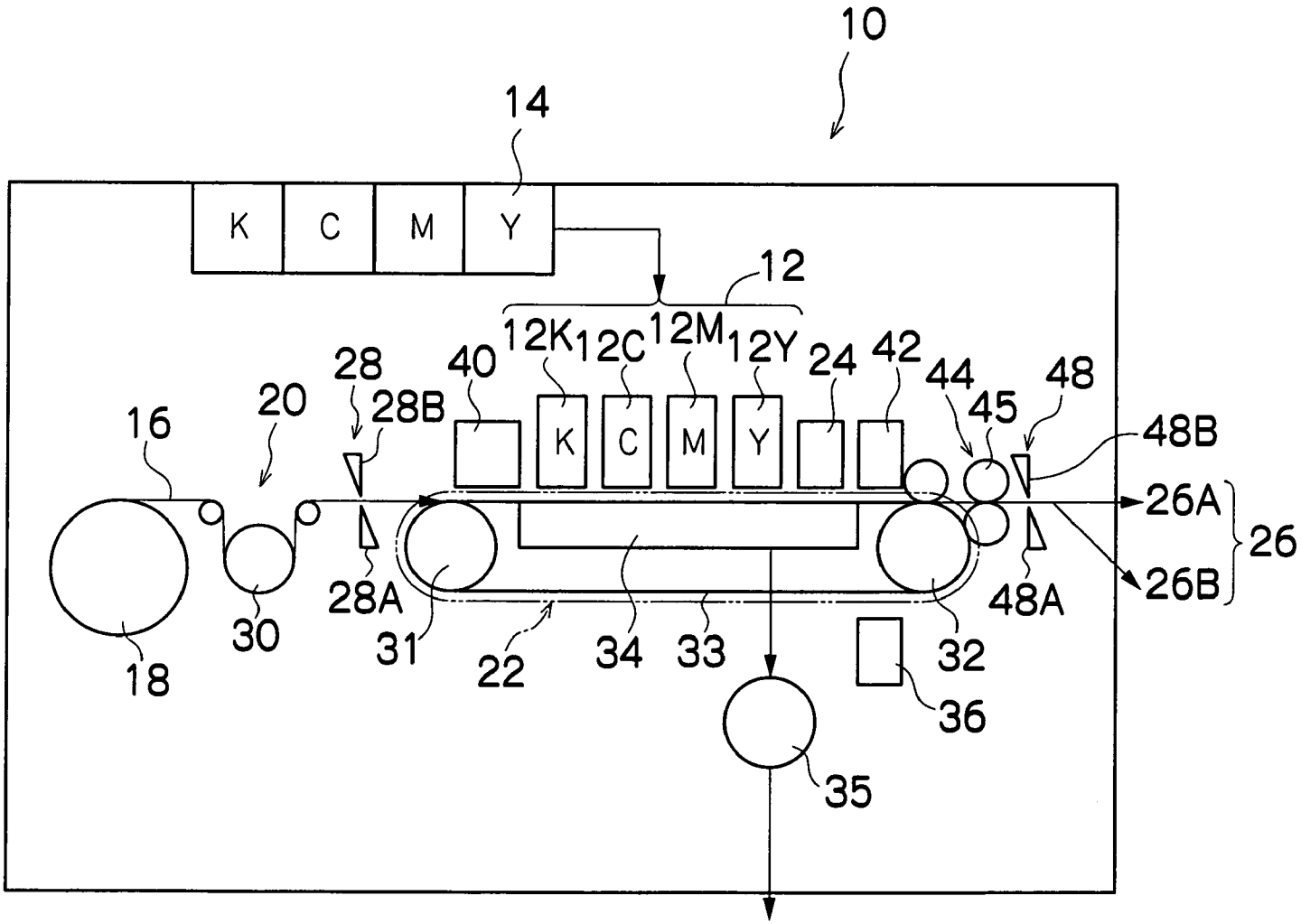
FIG. 1 is a general schematic drawing of an inkjet recording apparatus including a liquid ejection apparatus according to an embodiment of the present invention.

FIG. 1 is a diagram of the general composition of an inkjet recording apparatus 10 according to an embodiment of the present invention. As shown in FIG. 1, the inkjet recording apparatus 10 comprises: a printing unit 12 having a plurality of liquid ejection heads 12K, 12C, 12M, and 12Y for ink colors of black (K), cyan (C), magenta (M), and yellow (Y), respectively; an ink storing and loading unit 14 for storing inks of K, C, M and Y to be supplied to the liquid ejection heads 12K, 12C, 12M, and 12Y; a paper supply unit 18 for supplying recording paper 16 as a recording medium; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed results produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium, such as a bar code or a wireless tag, containing information about the type of paper be attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed from left to right in FIG. 1. The belt 33 is described in detail later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include: a configuration of nipping a brush roller, a water absorbent roller, or the like; an air blow configuration in which clean air is blown; and a combination of these. In the case of the configuration of nipping the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a possibility that, in the roller nip conveyance mechanism, the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
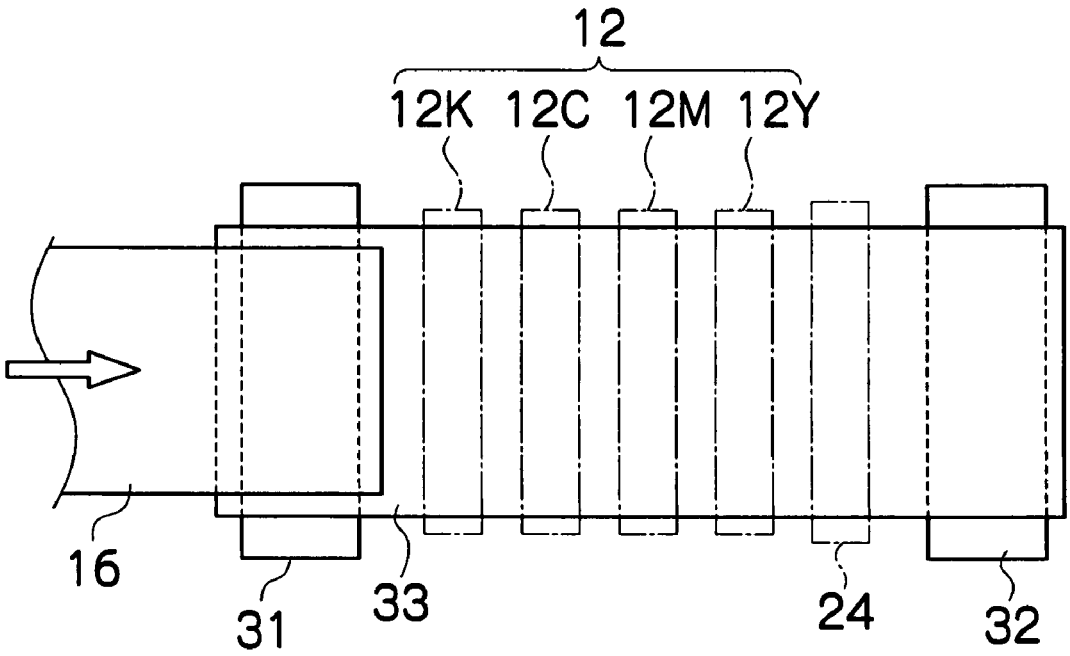
FIG. 2 is a plan view of the principal part of the peripheral area of a liquid ejection head in the inkjet recording apparatus shown in FIG. 1.

Each head of the print unit 12 is a so-called "full line head" in which a line head having a length corresponding to the maximum paper width is arranged in a direction that is perpendicular to the paper feed direction (recording medium conveyance direction) (see FIG. 2). An example of the detailed structure is described below, and each of the liquid ejection heads 12K, 12C, 12M, and 12Y is constituted by a line head, in which a plurality of ink ejection ports (nozzles) are arranged with a length that exceeds at least one side of the maximum-size recording paper 16 intended for use in the inkjet recording apparatus 10, as shown in FIG. 2.

The liquid ejection heads 12K, 12C, 12M, and 12Y are arranged in the order of black (K), cyan (C), magenta (M), and yellow (Y) from the upstream side, in the feed direction of the recording paper 16 (hereinafter, referred to also as the recording medium conveyance direction). A color image can be formed on the recording paper 16 by ejecting the inks from the liquid ejection heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the conveyance direction of the recording medium just once (in other words, by means of a single scan in the conveyance direction of the recording medium). Higher-speed printing is thereby made possible and productivity can be improved in comparison with a serial (shuttle scanning) type of head in which a liquid ejection head moves back and forth reciprocally in a direction substantially perpendicular to the conveyance direction of the recording medium.

Although a configuration with four standard colors, K M C and Y, is described in the present embodiment, the combinations of the ink colors and the number of colors are not limited to these, and light and/or dark inks can be added as required. For example, a configuration is possible in which liquid ejection heads for ejecting light-colored inks such as light cyan and light magenta are added.

As shown in FIG. 1, the ink storing and loading unit 14 has ink tanks for storing the inks of the colors corresponding to the respective liquid ejection heads 12K, 12C, 12M, and 12Y, and the respective tanks are connected to the liquid ejection heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for ejection defects, such as clogs of the nozzles in the printing unit 12, according to the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the liquid ejection heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image (a real image) printed by the liquid ejection heads 12K, 12C, 12M, and 12Y for the respective colors, and the ejection of each head is determined. The ejection determination includes the presence of the ejection, measurement of the dot size, and measurement of the dot deposition position. The print determination unit 24 comprises a light source (not shown in the drawings) for irradiating dots deposited with light.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming in contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders. The reference numeral 26B is a test print output unit.

Next, the structure of a liquid ejection head 50 is described below. The liquid ejection heads 12K, 12C, 12M and 12Y of the respective ink colors have the same structure, and a reference numeral 50 is hereinafter designated to any of the liquid ejection heads.

Figure 3A:
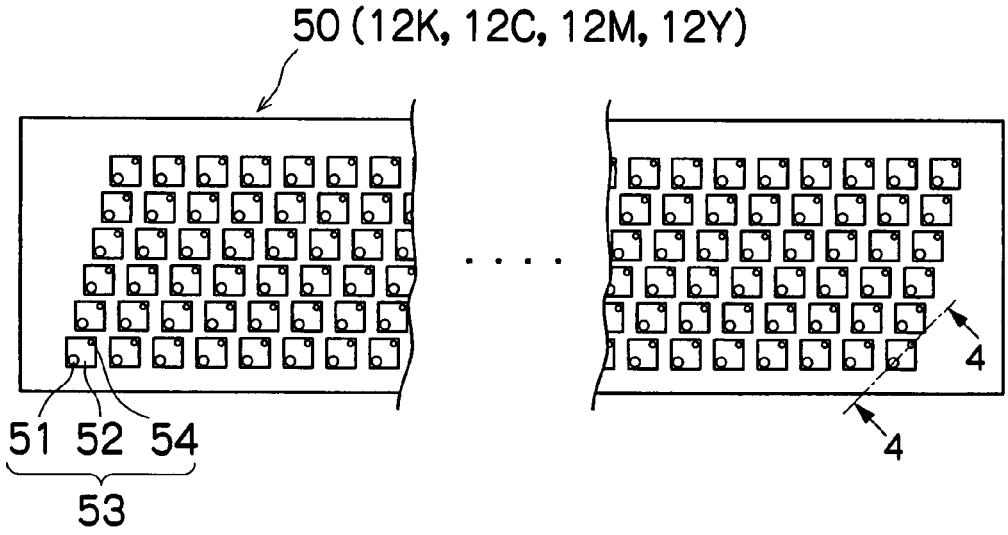
FIGS. 3A to 3C are plan perspective diagrams showing examples of the structure of a liquid ejection head.
Figure 3B:
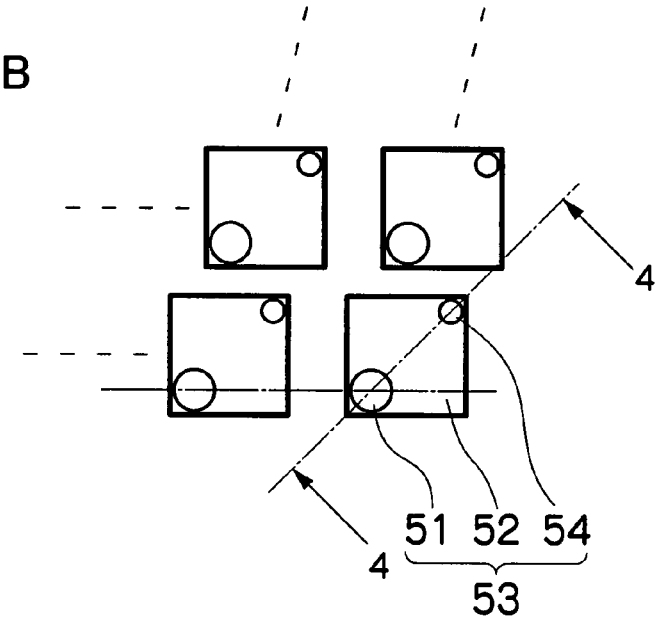
Figure 3C:
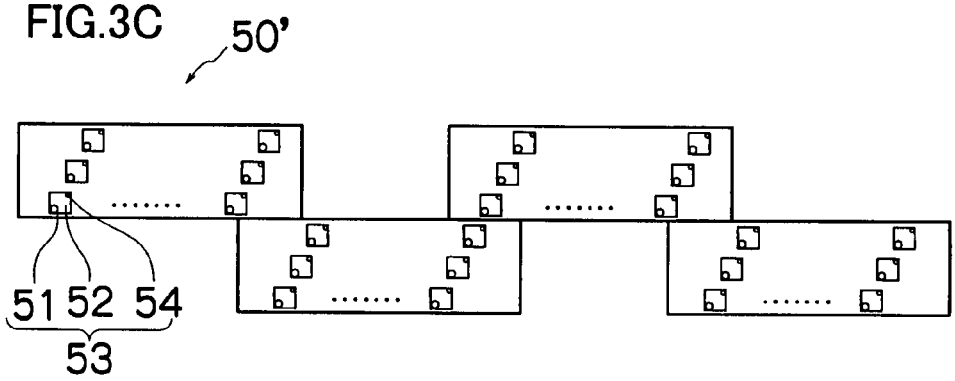
Figure 4:
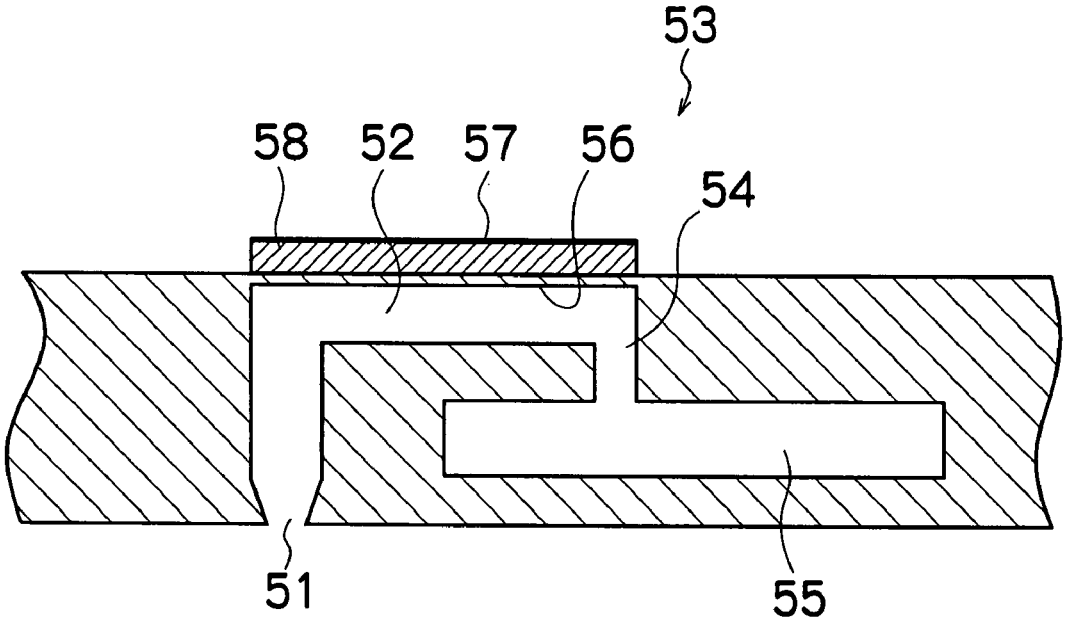
FIG. 4 is a cross-sectional view along line 4-4 in FIGS. 3A and 3B.

FIG. 3A is a plan view perspective diagram showing an example of the composition of the liquid ejection head 50, and FIG. 3B is an enlarged diagram of a portion of it. Furthermore, FIG. 3C is a plan view perspective diagram showing a further example of the composition of the liquid ejection head 50 (namely, a liquid ejection head 50'), and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording medium, it is necessary to achieve a high density of the nozzle pitch in the liquid ejection head 50. As shown in FIGS. 3A to 3C and FIG. 4, the liquid ejection head 50 in the present embodiment has a structure in which a plurality of ink chamber units 53 each of which includes a nozzle 51 for ejecting ink droplets and a pressure chamber 52 connecting to a nozzle 51 are disposed in the form of a staggered matrix, and the effective nozzle pitch is thereby made small.

More specifically, as shown in FIGS. 3A and 3B, the liquid ejection head 50 according to the present embodiment is a full-line head having one or more nozzle rows in which a plurality of nozzles 51 for ejecting ink are arranged with a length corresponding to the entire width of the recording medium in a direction substantially perpendicular to the recording medium conveyance direction of the recording medium.

Moreover, as shown in FIG. 3C, a full-line head can be composed of a plurality of short two-dimensionally arrayed head units 50' disposed in a staggered arrangement and combined so as to form nozzle rows which have a length that corresponds to the entire width of the recording paper 16.

The pressure chamber 52 provided corresponding to each of the nozzles 51 is approximately square-shaped in plan view, and a nozzle 51 and a supply port 54 are provided respectively at either corner of a diagonal of each pressure chamber 52. Each pressure chamber 52 is connected via the supply port 54 to a common flow channel that is not shown in FIGS. 3A and 3B.

Actuators 58 each of which is provided with an individual electrode 57 are joined to a diaphragm 56 which forms the upper face of the pressure chamber 52, and each actuator 58 is deformed when a drive voltage is supplied to the individual electrode 57, thereby causing ink to be ejected from the nozzle 51. When ink is ejected, new ink is supplied to the pressure chamber 52 from the common flow channel, via the supply port 54.

The plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure in which a plurality of ink chamber units 53 are arranged at a uniform pitch d in a direction having an angle θ with respect to the main scanning direction, the pitch P of the nozzles projected so as to align in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

Furthermore, when the present invention is implemented, the arrangement of the nozzles is not limited to that of the example illustrated. Moreover, the present embodiment adopts a method in which ink droplets are ejected by the deformation of the actuators 58, typically piezo elements (piezoelectric elements). However, in implementing the present invention, the method of ejecting ink is not limited in particular, and it is also possible to adopt various other methods, such as a thermal inkjet method in which ink is heated by a heating element, such as a heater, thereby generating an air bubble whose pressure causes ink to be ejected.

Figure 5:
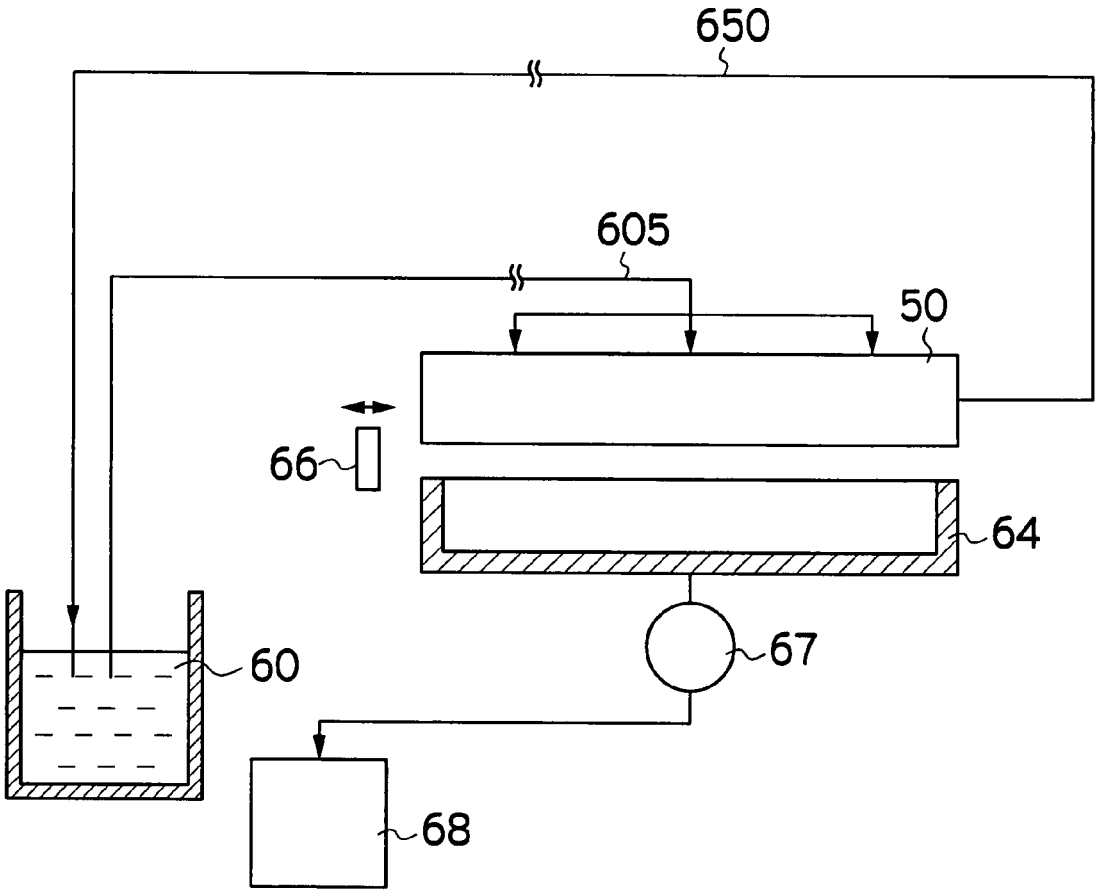
FIG. 5 is a principal block diagram showing the basic configuration of a liquid supply system of the inkjet recording apparatus shown in FIG. 1.

FIG. 5 is a schematic drawing showing an embodiment of configuration of the ink supply system in the inkjet recording apparatus 10.

The liquid tank 60 is a base tank serving as a supply source of ink, and is set in the ink storing and loading unit 14 described with reference to FIG. 1. The examples of the liquid tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

Furthermore, a sub-tank (not illustrated) may be provided between the liquid tank 60 and the liquid ejection head 50. The sub-tank has a damper function for preventing variation in the internal pressure of the head and a function for improving refilling of the liquid ejection head 50. Possible modes for controlling the internal pressure by means of the sub-tank include: a mode where the internal pressure of each ink chamber unit 53 is controlled on the basis of the ink level differential between the sub-tank which is open to the external air and the ink chamber unit 53 inside the liquid ejection head 50; and a mode where the internal pressures of the sub-tank and the ink chambers are controlled by a pump connected to a sealed sub tank; and the like. Either of these modes may be adopted.

The ink in the liquid tank 60 is supplied to the liquid ejection head 50 by means of a liquid supply channel 605 extending from the liquid tank 60 to the liquid ejection head 50.

The ink inside the liquid ejection head 50 that has not yet been ejected is sent to the liquid tank 60 by means of a liquid circulation channel 650 leading from the liquid ejection head 50 to the liquid tank 60, and then sent to the liquid ejection head 50 again by means of the liquid circulation channel 605.

The inkjet recording apparatus 10 includes: a cap 64 as a device to prevent the nozzles 51 from drying out or to prevent an increase in the ink viscosity in the vicinity of the nozzles 51; and a cleaning blade 66 as a device to clean the nozzle face.

A maintenance unit including the cap 64 and the cleaning blade 66 can be relatively moved with respect to the liquid ejection head 50 by a movement mechanism (not shown), and is moved from a predetermined holding position to a maintenance position below the liquid ejection head 50 as required.

The cap 64 is displaced up and down relatively with respect to the liquid ejection head 50 by an elevator mechanism (not shown). When the power of the inkjet recording apparatus 10 is turned OFF or when it is in a print standby state, the cap 64 is raised to a predetermined elevated position so as to come into close contact with the liquid ejection head 50, and the nozzle face (ink ejection face) is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it may become difficult to eject ink from the nozzle 51 even if the actuator 58 is operated.

Therefore, before a situation of this kind occurs (more specifically, while the ink is within a range of viscosity which allows it to be ejected by operation of the actuator 58), the actuator 58 is operated, and a preliminary ejection ("purge", "blank ejection" or "liquid ejection") is carried out toward the cap 64 (ink receptacle), in order to expel the degraded ink (namely, the ink in the vicinity of the nozzle which has increased viscosity).

Furthermore, if air bubbles enter into the ink inside the liquid ejection head 50 (pressure chamber 52), then even if the actuator 58 is operated, it may be difficult to eject ink from the nozzle. In a case of this kind, the cap 64 is placed on the liquid ejection head 50, the ink (ink containing air bubbles) inside the pressure chamber 52 is removed by suction, by means of a suction pump 67, and the ink removed by the suction is then sent to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface (surface of the nozzle plate) of the liquid ejection head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate. When the soiling on the ink ejection surface is cleaned away by the blade mechanism, a preliminary ejection is also carried out in order to prevent the foreign matter from becoming mixed inside the nozzle 51 by the blade.

The cap 64, the cleaning blade 66, the suction pump 67 and the recovery tank 68 described above constitute one portion of a device for recovering the solvent concentration in the ink in the liquid ejection head 50 (namely, a device for restoring the state of viscosity of the ink).

Furthermore, the inkjet recording apparatus 10 according to the present embodiment comprises a device which restores the gas dissolving capacity of the ink (the amount of gas that can be further dissolved in the ink). This device for restoring the gas dissolving capacity is described in detail below, with respect to embodiments of the present invention.

Figure 6:
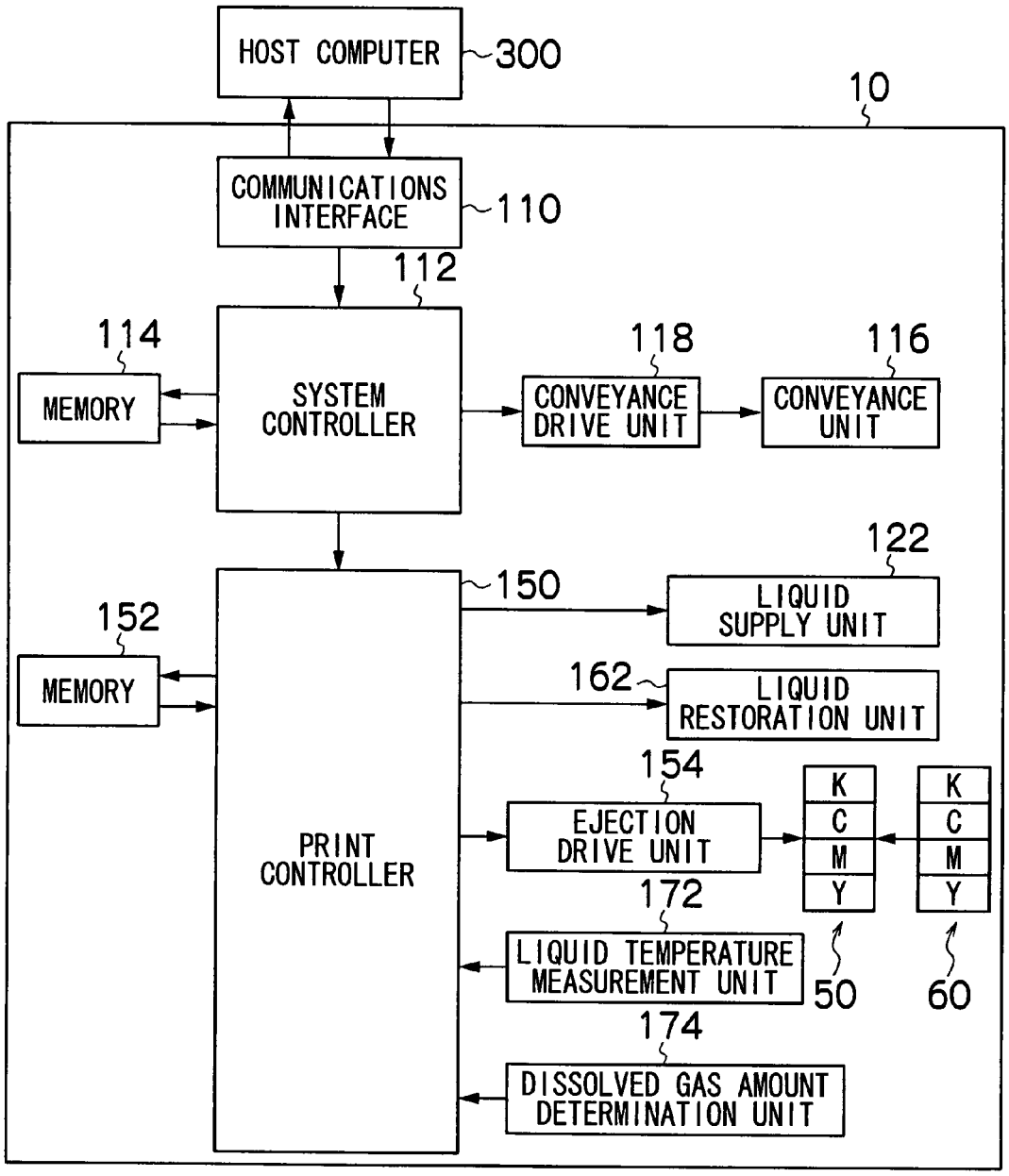
FIG. 6 is a block diagram showing a system composition of the inkjet recording apparatus.

FIG. 6 is a block diagram showing a system configuration of the inkjet recording apparatus 10.

In FIG. 6, the inkjet recording apparatus 10 principally comprises: the liquid ejection heads 50; the liquid tanks 60; a communications interface 110; a system controller 112; memories (first memory 114 and second memory 152); a conveyance unit 116; a conveyance drive unit 118; a liquid supply unit 122; a print controller 150; an ejection drive unit 154, a liquid restoration unit 162; a liquid temperature measurement unit 172; and a dissolved gas amount determination unit 174.

In the present embodiment, four liquid ejection heads 50 are provided to respectively eject inks of the colors of black (K), cyan (C), magenta (M) and yellow (Y).

The communications interface 110 is an image data input device for receiving image data transmitted by a host computer 300. It is possible to use a wired or a wireless interface for the communications interface 110. The image data acquired by the inkjet recording apparatus 10 via the communications interface 110 is stored temporarily in the first memory 114 for storing image data.

The system controller 112 is constituted by a microcomputer and peripheral circuits thereof, and the like, and it controls the whole of the inkjet recording apparatus 10 in accordance with prescribed programs. More specifically, the system controller 112 controls the communications interface 110, the conveyance drive unit 118, the print controller 150, and the like.

The conveyance unit 116 is constituted by the rollers 31 and 32, the belt 33, and the like, as shown in FIG. 1, in order to convey the recording medium such as paper. The relative movement of the liquid ejection head 50 and the recording medium is carried out by means of the conveyance unit 116.

The conveyance drive unit 118 is constituted by a motor and a drive circuit thereof which drive the conveyance unit 116 in accordance with instructions from the system controller 112.

The liquid supply unit 122 includes the liquid tanks 60 and channels (the liquid supply channel 605 and the liquid circulation channel 650 shown in FIG. 5, and the like), and it supplies ink from the inside the liquid tank 60 to the liquid ejection head 50.

The print controller 150 is constituted by a microcomputer and peripheral circuits thereof, and the like, and it controls the various sections including the liquid supply unit 122, the ejection drive unit 154, the liquid restoration unit 162, the liquid temperature measurement unit 172, the dissolved gas amount determination unit 174, and the like, in accordance with prescribed programs.

The print controller 150 generates the data necessary for forming dots on the recording medium by ejecting droplets from the respective liquid ejection heads 50 onto the recording medium, on the basis of the image data input to the inkjet recording apparatus 10. More specifically, the print controller 150 is a control unit which functions as an image processing device that carries out various image treatment processes, corrections, and the like, in accordance with the control implemented by the system controller 112, in order to generate dot data for controlling droplet ejection, from the image data in the first memory 114, and it supplies the dot data thus generated to the ejection drive unit 154.

The second memory 152 is appended to the print controller 150, and it temporarily stores dot data, and the like, during image processing by the print controller 150.

In FIG. 6, the second memory 152 is depicted as being appended to the print controller 150; however, the second memory 152 may also be combined with the first memory 114. Also possible is a mode in which the print controller 150 and the system controller 112 are integrated to form a single processor.

The ejection drive unit 154 outputs drive signals for ejection to the liquid ejection head 50 on the basis of the dot data supplied by the print controller 150 (in practice, the dot data stored in the second memory 152). More specifically, the ejection drive unit 154 applies liquid droplet ejection drive waveforms respectively and independently, to the plurality of actuators (58 in FIG. 1B) inside the liquid ejection head 50, each time liquid droplets are to be ejected from the nozzles 51.

The liquid restoration unit 162 carries out liquid restoration processing to reduce the amount of dissolved gas in the ink inside the liquid ejection head 50, under the control of the print controller 150, thereby restoring the gas dissolving capacity of the ink inside the liquid ejection head 50.

Here, the gas dissolving capacity of the ink indicates the amount of gas which can be further dissolved in the ink, and more specifically, it is expressed by "a differential between a saturated amount of dissolved gas and an actual amount of dissolved gas". This gas dissolving capacity is used as an indicator for estimating the liability of the dissolved gas to form gas bubbles.

There are various concrete modes of the liquid restoration processing by the liquid restoration unit 162. Firstly, there is a mode in which the amount of dissolved gas in the ink is reduced directly by removing the dissolved gas from the ink (namely, by deaeration); secondly, there is a mode in which ink containing a relatively large amount of dissolved gas is removed partially, from among all of the ink inside the inkjet recording apparatus 10 (for example, a mode where ink is suctioned from the liquid ejection head 50 by using the suction pump 67 shown in FIG. 5); and thirdly, there is a mode in which the amount of dissolved gas per unit volume of the ink is reduced, by returning the ink inside the liquid ejection head 50 which has a relatively large amount of dissolved gas and has a relatively small amount (a relatively small capacity) to the liquid tank 60 which has a relatively small amount of dissolved gas and has a relatively large amount (a relatively large capacity).

The liquid temperature measurement unit 172 measures at least one of the following temperatures: the temperature of the ink in the liquid ejection head 50, the temperature of the ink in the liquid supply unit 122, the temperature of the liquid ejection head 50, and the temperature of the liquid supply unit 122. In other words, the liquid temperature measurement unit 172 either measures the temperature of the ink inside the liquid ejection head 50 directly, or it estimates the temperature of the ink inside the liquid ejection head 50 indirectly, by measuring the temperature of the ink inside the liquid supply unit 122, the temperature of the liquid ejection head 50, the temperature of the liquid supply unit 122, or the like.

The following description relates to a case where the liquid temperature measurement unit 172 measures the temperature of the ink inside the liquid ejection head 50 shown in FIG. 4. For example, a thermistor (temperature meter) is disposed inside the common flow channel 55, and measures the temperature of the ink inside the common flow channel 55.

The dissolved gas amount determination unit 174 determines at least one of the dissolved gas amount in the ink inside the liquid ejection head 50 and the dissolved gas amount in the ink inside the liquid supply unit 122.

For example, a dissolved oxygen meter is disposed inside the common flow channel 55 of the liquid ejection head 50 shown in FIG. 4, and the amount of dissolved oxygen in the common flow channel 55 measured by this dissolved oxygen meter is treated as the amount of dissolved gas in the ink. Furthermore, it is also possible to dispose a dissolved oxygen meter inside the liquid supply channel 605 shown in FIG. 5, and to treat the amount of dissolved oxygen in the liquid supply channel 605 measured by this dissolved oxygen meter, as the amount of dissolved gas of the ink inside the common flow channel 55 of the liquid ejection head 50. The gas dissolved in the ink is generally air, and oxygen, which is the most easily measurable of the components of air, is measured by the dissolved gas amount determination unit 174 which serves as a dissolved oxygen meter.

The invention is not limited to a case where the amount of dissolved gas in the ink is actually measured, and it is also possible to estimate the amount of dissolved gas in the ink by means of an estimation process.

In the following, an example of cases where the dissolved gas amount determination unit 174 determines (measures or estimates) the amount of dissolved oxygen of the ink inside the liquid ejection head 50 is described.

The liability of the dissolved gas to form gas bubbles in the ink varies with environmental change, principally, variation in the ink temperature and variation in the ink pressure. If unnecessary air bubbles generate unintentionally in the ink inside the liquid ejection head 50, then there is a loss of ejection pressure inside the pressure chamber 52 and an ejection abnormality, such as an ejection failure, may occur.

The print controller 150 estimates the saturated amount of oxygen in the ink inside the liquid ejection head 50 on the basis of a temperature of the ink inside the liquid ejection head 50 measured by the liquid temperature measurement unit 172. In this case, since the saturated amount of dissolved gas is estimated on the assumption of a non-ejection state (i.e., conditions where the pressure is substantially constant), then the variation in the ink pressure inside the liquid ejection head 50 is ignored. But, in cases where the variation in the pressure cannot be ignored, it is preferable that the saturated amount of dissolved oxygen in the ink be estimated according to not only the ink temperature inside the liquid ejection head 50 but also the ink pressure inside the liquid ejection head 50.

Figure 7:
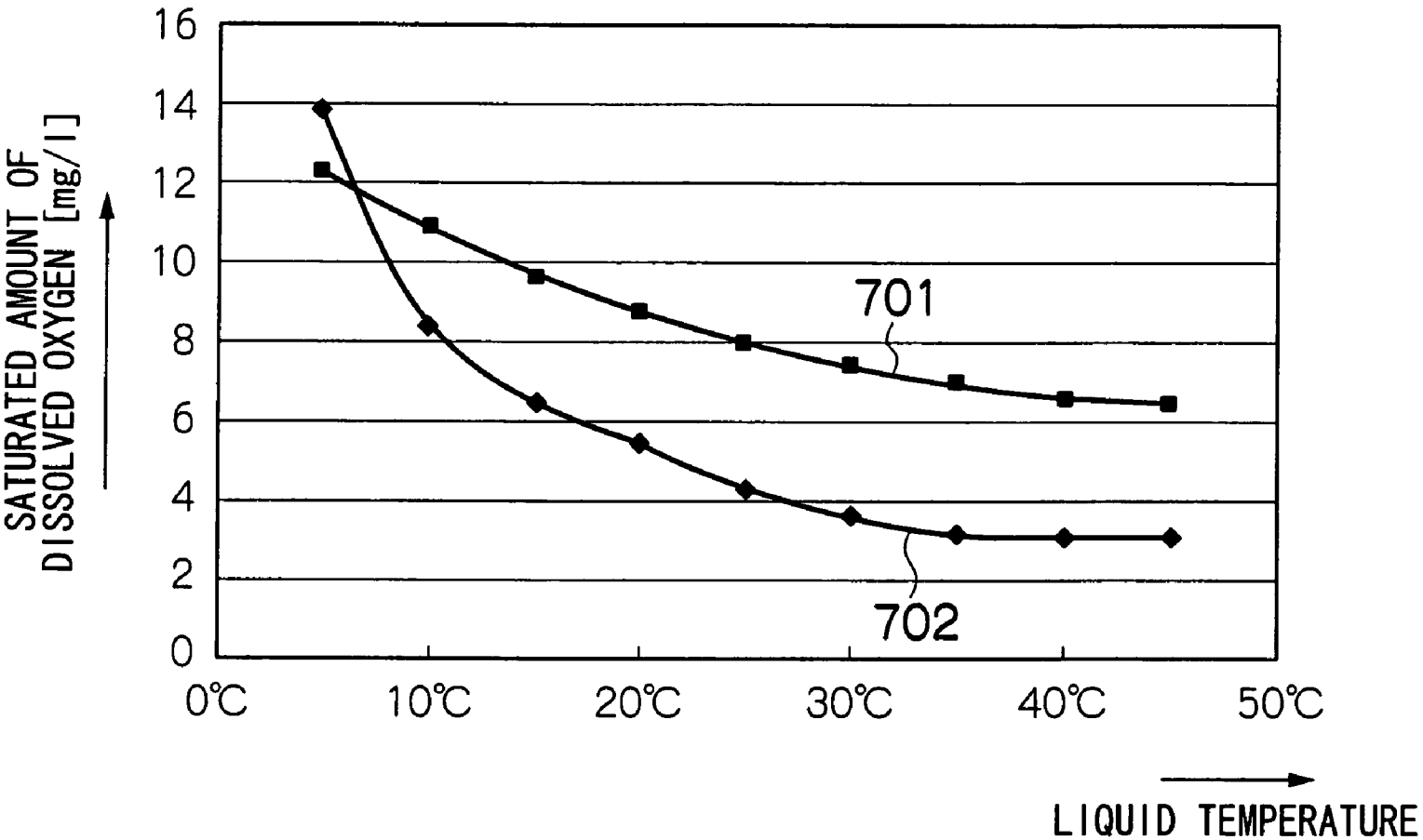
FIG. 7 is an illustrative diagram used in the description of a conversion table of the "temperature–saturated amount of dissolved gas"

FIG. 7 is a diagram showing the relationship between the liquid temperature and the saturated amount of dissolved oxygen. In FIG. 7, the first characteristic curve 701 indicates the relationship between the ink temperature and the saturated amount of dissolved oxygen in the ink, and the second characteristic curve 702 indicates the relationship between water temperature and the saturated amount of dissolved oxygen in water.

The inkjet recording apparatus 10 according to the present embodiment previously stores the relationship (which is indicated by the first characteristics curve 701 in FIG. 7) between the ink temperature and the saturated amount of dissolved oxygen in the ink, in the second memory 152, in the form of a conversion table.

The print controller 150 refers to the conversion table stored in advance in the second memory 152, and thereby estimates the saturated amount of dissolved gas corresponding to the ink temperature measured by the liquid temperature measurement unit 172. There are various possible modes whereby the print controller 150 acquires the saturated amount of dissolved gas on the basis of the ink temperature, and these are described in more detail below.

Furthermore, the print controller 150 calculates the differential between the saturated amount of dissolved gas estimated by the print controller 150 and the amount of dissolved gas determined by the dissolved gas amount determination unit 174. In other words, the print controller 150 calculates the amount of gas that can be further dissolved in the ink in which gas has already been dissolved (which corresponds to "gas dissolving capacity").

The print controller 150 controls whether or not to implement liquid restoration processing with the liquid restoration unit 162, in accordance with the gas dissolving capacity calculated by the print controller 150.

In the embodiment shown in FIG. 6, the print controller 150 serves as the saturated amount of dissolved gas determination device and the liquid restoration control device according to the present invention.

Below, embodiments of the restoration of the gas dissolving capacity of the liquid in the liquid ejection head 50 (hereinafter, simply also called "liquid restoration") are described in detail.

First Embodiment

Figure 8:
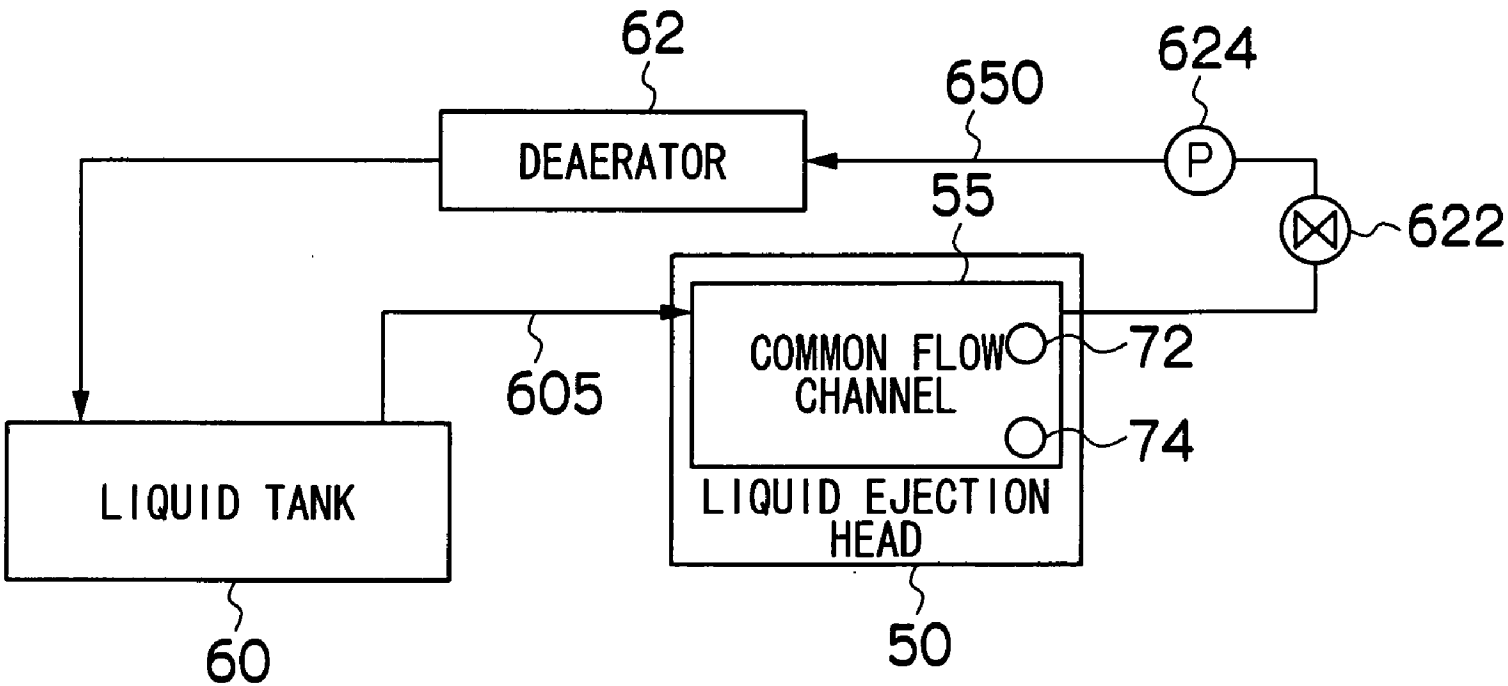
FIG. 8 is a block diagram showing the principal part of liquid restoration according to a first embodiment.

FIG. 8 is a block diagram showing the principal parts relating to liquid restoration in the inkjet recording apparatus 10 according to a first embodiment of the present invention. In FIG. 8, the constituent elements described above with reference to the block diagram of the ink supply system shown in FIG. 5 are labeled with the same reference number, and the details described above are omitted. In FIG. 8, the direction indicated by the arrows is the direction in which the ink flows.

As shown in FIG. 8, in the present embodiment, a valve 622, a liquid driving pump 624 and a deaerator 62 are provided in the liquid circulation channel 650 leading from the liquid ejection head 50 to the liquid tank 60. More specifically, the liquid tank 60, the liquid ejection head 50, the valve 622, the liquid driving pump 624, and the deaerator 62 are disposed in this order from the upstream side of the liquid supply channel 605 to the downstream side of the liquid circulation channel 650.

Furthermore, a temperature meter 72 serving as the liquid temperature measurement unit 172 in FIG. 6 and a dissolved oxygen meter 74 serving as the dissolved gas amount determination unit 174 in FIG. 6 are disposed inside the common flow channel 55 of the liquid ejection head 50.

Figure 9:
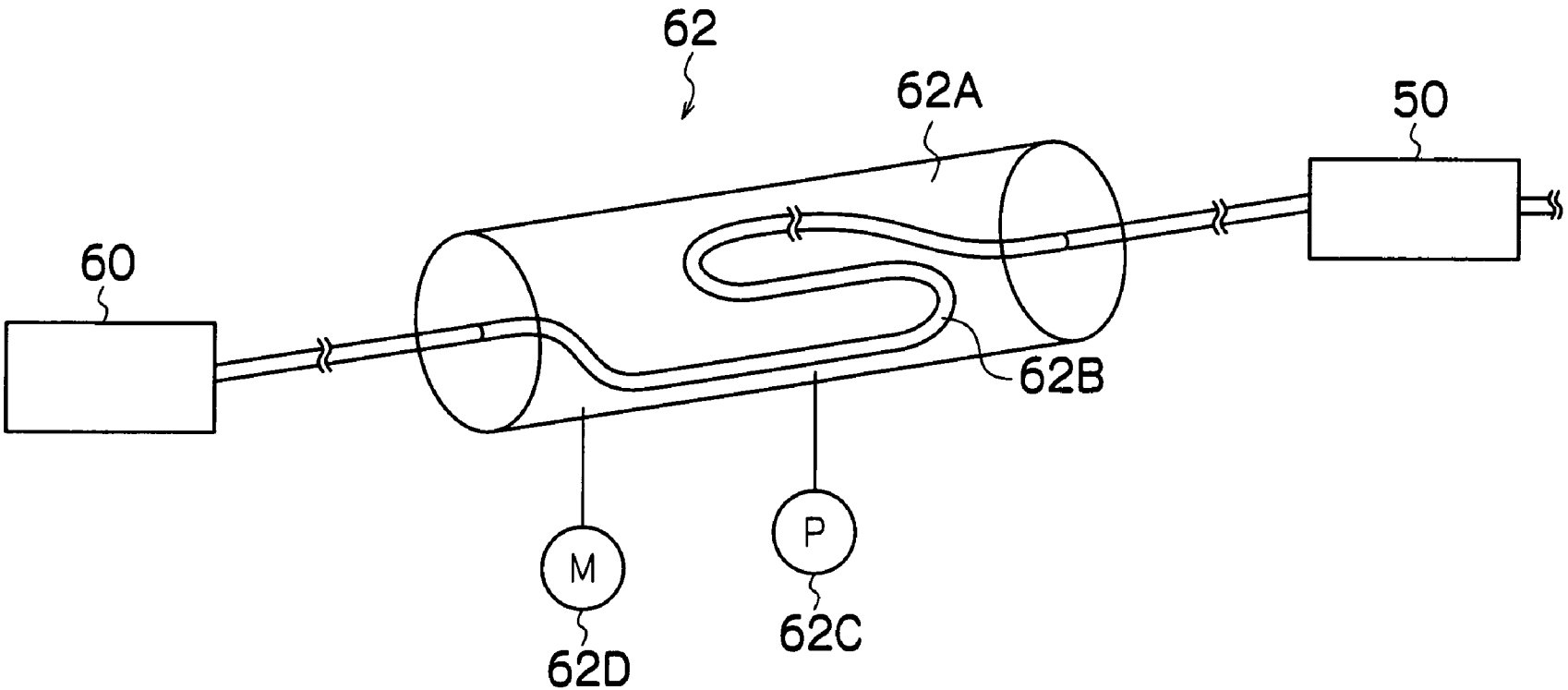
FIG. 9 is a compositional drawing showing one example of deaerator.

FIG. 9 is an approximate schematic drawing of the deaerator 62 shown in FIG. 8.

The deaerator 62 includes a deaerating region 62A, and an internal ink flow channel 62B in the deaerating region 62A. The internal ink flow channel 62B is constituted by a hollow fiber bundle which is gas-permeable, such as a fluorine-based tube or silicone-based tube. The ink supplied from the liquid ejection head 50 is subjected to deaeration at reduced pressure when it passes through the internal ink flow channel 62B, whereupon it is supplied to the liquid tank 60.

In the reduced pressure deaeration process, when the pressure of the deaerating region 62A is reduced by means of a vacuum pump 62C, the gas dissolved in the ink is separated from the ink due to the action of the negative pressure acting on the outer circumference of the internal ink flow channel 62B, and the separated gas is discharged into the atmosphere via the vacuum pump 62C. Moreover, the deaerator 62 also comprises a vacuum gauge 62D to monitor the pressure (level of vacuum) in the deaerating region.

As for the deaerating method used for the ink in the deaerator 62, in addition to the above-described known technique of a vacuum method (depressurization deaeration), various other methods, such as an ultrasonic vibration method and a centrifugal separation method, may also be used.

The valve 622 shown in FIG. 8 opens and closes the liquid circulation channel 650.

The liquid driving pump 624 shown in FIG. 8 sends the ink inside the common flow channel 55 of the liquid ejection head 50 to the liquid tank 60.

The deaerator 62, valve 622 and liquid driving pump 624 shown in FIG. 8 serve as the liquid restoration unit 162 shown in FIG. 6, and they are controlled by the print controller 150 shown in FIG. 6.

In order to carry out the liquid restoration process, the print controller 150 shown in FIG. 6 sets the valve 622 on the liquid circulation channel 650 to an open state, drives the liquid driving pump 624 so that the ink inside the common flow channel 55 of the liquid ejection head 50 is sent to the liquid tank 60 via the liquid circulation channel 650, and also drives the deaerator 62 so that dissolved gas (including oxygen and other gases) is removed from the ink inside the liquid circulation channel 650.

Preferably, the liquid tank 60 is a bag body (a plastic bag) which has plasticity properties and which is made of an airtight member that has been subjected to a treatment such as aluminum vapor deposition. Desirably, the ink inside the liquid tank 60 is deaerated ink that has been previously deaerated.

Next, an example of the liquid restoration processing in the inkjet recording apparatus 10 according to the first embodiment is described.

Figure 10:
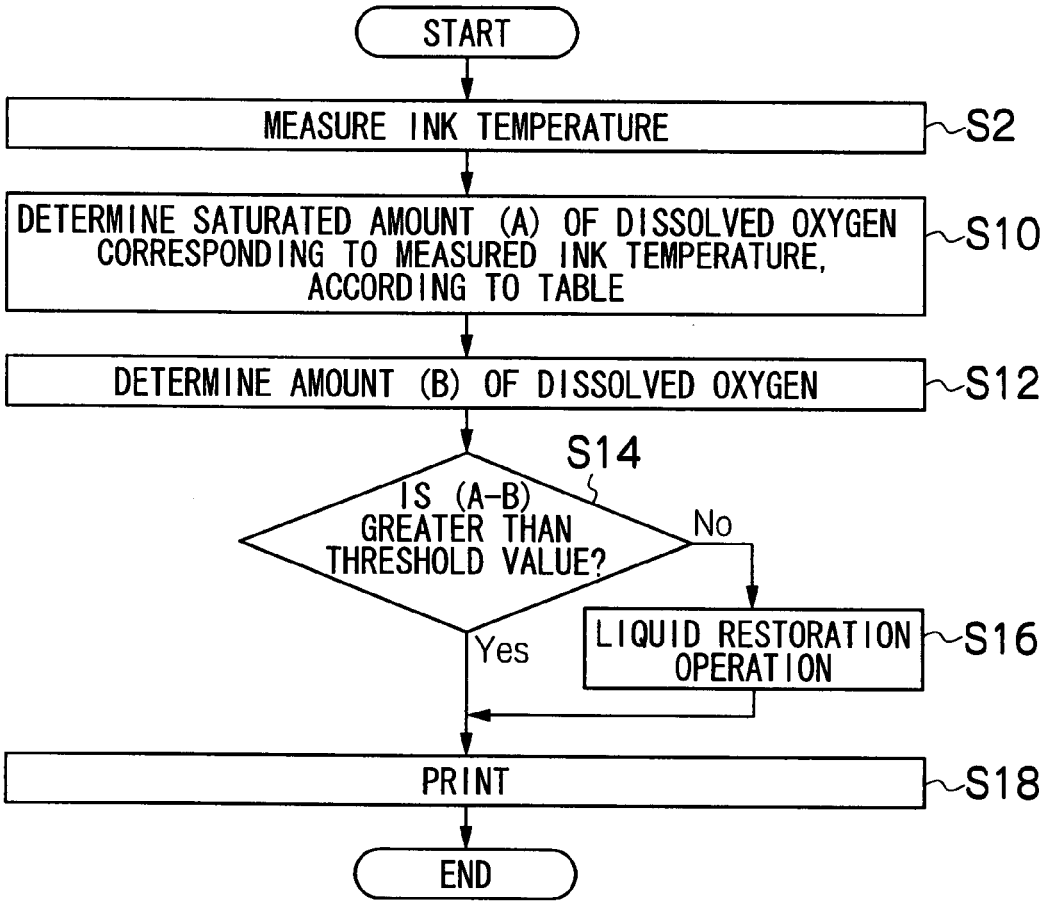
FIG. 10 is a flowchart showing one example of liquid restoration processing.

FIG. 10 is a flowchart showing a sequence of one embodiment of the liquid restoration processing. This liquid restoration processing is implemented by the print controller 150 shown in FIG. 6, in accordance with a prescribed program.

As shown in FIG. 10, firstly, the ink temperature inside the common flow channel 55 of the liquid ejection head 50 is measured by the temperature meter 72 (step S2).

Thereupon, the print controller 150 shown in FIG. 6 estimates the saturated amount "A" of dissolved oxygen corresponding to the ink temperature measured at step S2, by using the conversion table (which describes the relationship between ink temperature and saturated amount of dissolved oxygen) stored previously in the memory 152 shown in FIG. 6 (step S 10).

Next, the amount of oxygen (amount "B" of dissolved oxygen) actually dissolved in the ink inside the common flow channel 55 of the liquid ejection head 50 is measured by the dissolved oxygen meter 74 (step S12).

Thereupon, the print controller 150 calculates the liquid dissolving capacity, namely, the differential (A−B) between the saturated amount "A" of dissolved oxygen estimated at step S10 and the amount "B" of dissolved oxygen of the ink measured at step S12, and it judges whether or not this differential (A−B) is greater than a previously established threshold value (step S14).

In order to carry out the liquid restoration suitably, it is preferable that the threshold value be set so that the gas dissolution rate is sufficiently slow, and for example, the threshold value is preferably set to a value of 1.5 mg/l in terms of an amount of dissolved oxygen.

If the differential (A−B) between the saturated amount of dissolved oxygen and the amount of dissolved oxygen of the ink is equal to or less than the threshold value, then the liquid restoration process is carried out (step S16).

In the inkjet recording apparatus 10 according to the present embodiment, in the liquid restoration process (step S16), the valve 622 in the liquid circulation channel 650 is opened and ink which has not been ejected and which is present in the common flow channel 55 of the liquid ejection head 50 is sent to the liquid tank 60 via the liquid circulation path 650 by the liquid driving pump 624. Moreover, dissolved gas is removed from the liquid inside the liquid circulation channel 650 by the deaerator 62 in the liquid circulation channel 650.

Thereupon, printing is carried out by means of the liquid ejection head 50 (step S18).

Figure 11:
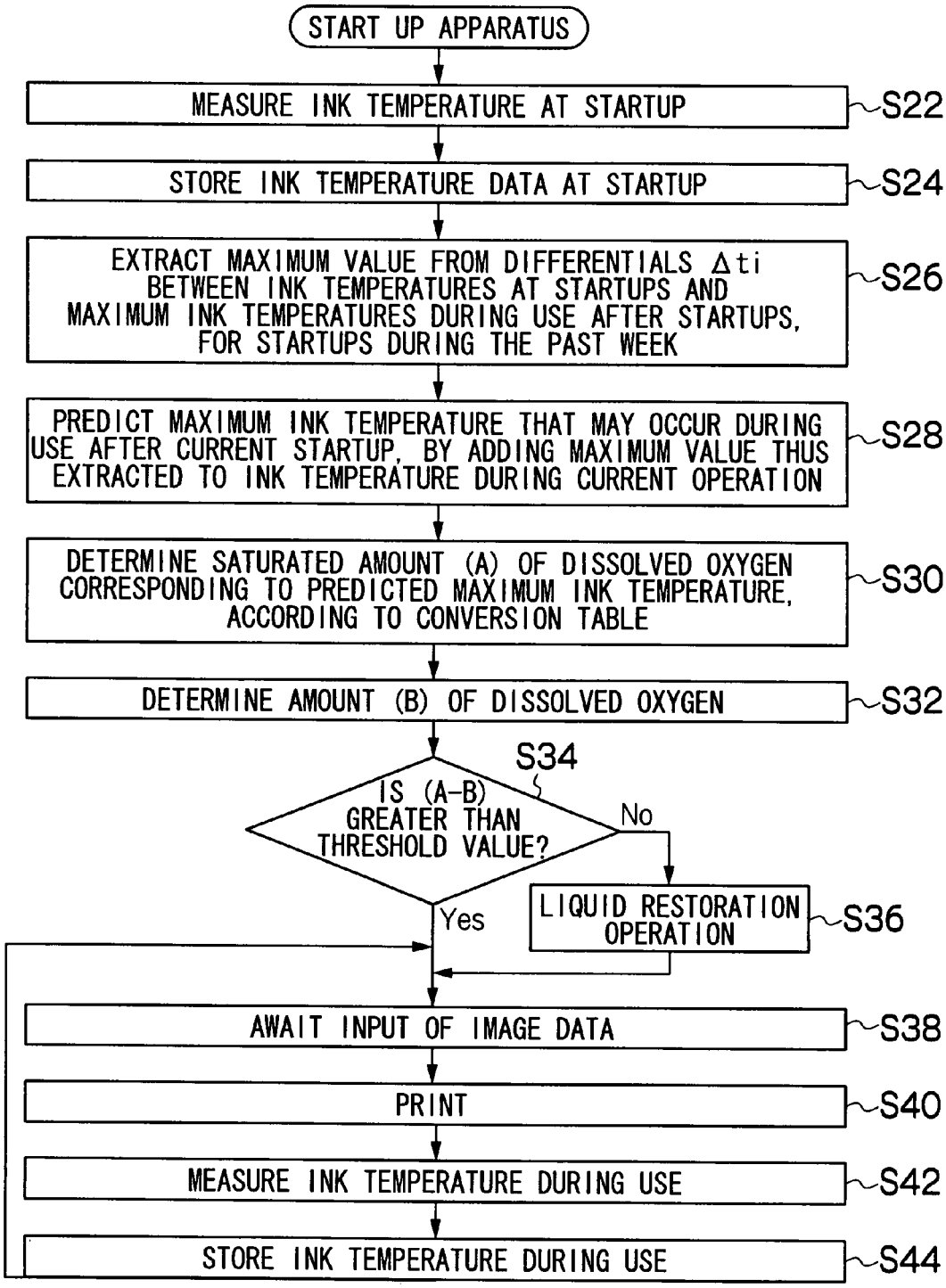
FIG. 11 is a flowchart showing a further example of liquid restoration processing.

FIG. 11 is a flowchart showing a sequence of a further embodiment of the liquid restoration processing. This liquid restoration processing is implemented by the print controller 150 shown in FIG. 6, in accordance with a prescribed program.

In the present embodiment, data (temperature change history data) of the variation in the ink temperature over a prescribed time period in the recent past (for example, over the past week) is stored in the memory 152 shown in FIG. 6 under the control of the print controller 150. More specifically, the temperature change history includes: the ink temperatures inside the common flow channel 55 of the liquid ejection head 50 at past startups of the inkjet recording apparatus 10 (which are referred to also as "startup ink temperatures"); the maximum ink temperatures inside the common flow channel 55 of the liquid ejection head 50 during operations after the past startups of the inkjet recording apparatus 10 (which are referred to also as "maximum ink temperatures during use"); and the differential between each startup ink temperature and the maximum ink temperature during use after each past startup of the inkjet recording apparatus 10 (which is referred to also as an "ink temperature increase").

In FIG. 11, when the inkjet recording apparatus 10 is started up, the ink temperature (the current startup ink temperature) in the common flow channel 55 of the liquid ejection head 50 is measured by the temperature meter 72 (step S22). The startup ink temperature thus measured is recorded in the memory 152 shown in FIG. 6 as a part of the temperature change history described above (step S24).

Thereupon, the print controller 150 shown in FIG. 6 refers to the temperature change history previously stored in the memory 152 shown in FIG. 6, and extracts the maximum value from the differentials Δti (i.e., the ink temperature increases for the respective startups) over the prescribed time period in the past (for example, the past week) (step S26). Here, each of the differentials Δti is a differential between the startup ink temperature and the maximum ink temperature during use for each startup.

Figure 12:
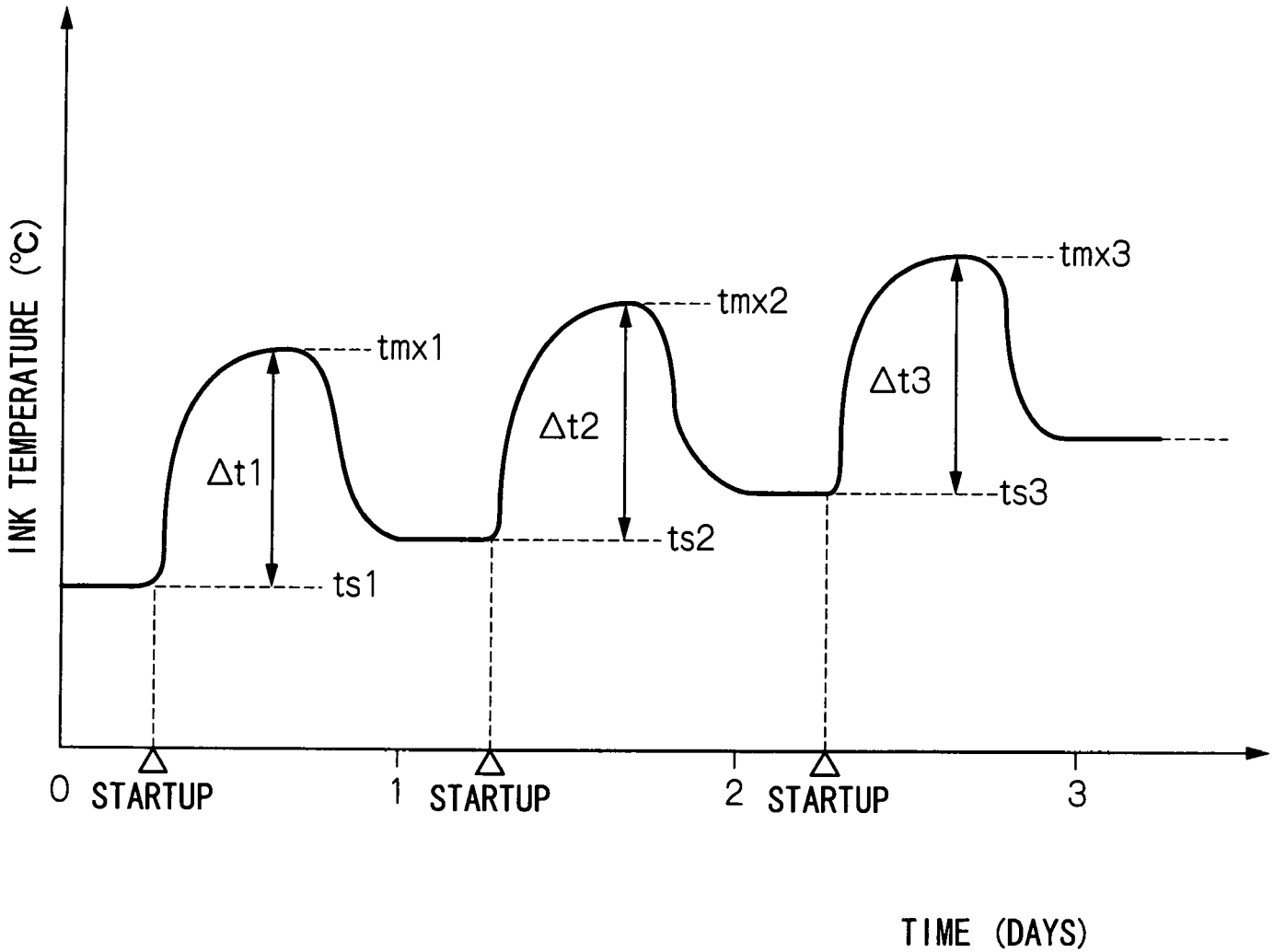
FIG. 12 is an illustrative diagram used for describing the prediction of the maximum liquid temperature which may occur during use after startup of the inkjet recording apparatus.

For example, FIG. 12 is a diagram showing the ink temperature increases (Δt1, Δt2, Δt3) for the first three days of the past week. The ink temperature increases Δt1, Δt2, and Δt3 respectively denote the differential between the maximum ink temperature during use "tmx1" and the startup ink temperature "ts1" from 7 days previously (i.e., first day), the differential between the maximum ink temperature during use "tmx2" and the startup ink temperature "ts2" from 6 days previously (i.e., second day), and the differential between the maximum ink temperature during use "tmx3" and the startup ink temperature "ts3" from 5 days previously (i.e., third day); in other words, the ink temperature increases Δt1, Δt2, and Δt3 denote the differentials "tmx1−ts1", "tmx1−ts1", and "tmx1−ts1" respectively. Data of these ink temperature increases (Δt1, Δt2, Δt3) are stored in the temperature change history. Similarly, the ink temperature increases (Δt4, Δt5, Δt6, Δt7) for 4 days previously to one day previously are also stored in the temperature change history. If the ink temperature increase Δt3 of 5 days previously (i.e., third day) is the maximum value amongst these ink temperature increases Δti (i=1 to 7), then this value, Δt3, is extracted. In this case, the ink temperature increase on a day when the inkjet recording apparatus 10 is not started up is excluded and is not stored in the temperature change history.

Thereupon, the print controller 150 predicts the maximum ink temperature that may occur during use after the current startup (which is the possible maximum ink temperature and is referred to also as "the maximum ink temperature during the current use") by adding the maximum value extracted (for example, Δt3) at step S26 to the current startup ink temperature measured at step S22 (step S28).

Thereupon, the print controller 150 determines the saturated amount "A" of dissolved oxygen corresponding to the maximum ink temperature during the current use predicted above, on the basis of the "ink temperature−saturated dissolved oxygen amount" conversion table previously stored in the memory 152 (step S30).

Thereupon, the amount of oxygen actually dissolved in the ink in the common flow channel 55 of the liquid ejection head 50 (dissolved oxygen amount "B") is measured by the dissolved oxygen meter 74 (step S32).

Subsequently, the print controller 150 calculates the differential (A−B) between the saturated dissolved oxygen amount "A" determined at step S30 and the current dissolved oxygen amount "B" in the ink measured at step S32, and it determines whether or not this differential (A−B), namely, the gas dissolving capacity, is greater than a previously established threshold value (step S34).

In order to carry out the liquid restoration suitably, it is preferable that the threshold value be set so that the gas dissolution rate is sufficiently slow, and for example, the threshold value is preferably set to a value of 1.5 mg/l in terms of an amount of dissolved oxygen.

If the differential (A−B) between the saturated amount of dissolved oxygen and the amount of dissolved oxygen in the ink is equal to or less than the threshold value, then the liquid restoration process is carried out (step S36).

In the inkjet recording apparatus 10 according to the present embodiment, in the liquid restoration step (step S36), the valve 622 in the liquid circulation channel 650 is opened, and ink which has not been ejected and which is present in the common flow channel 55 of the liquid ejection head 50 is sent to the liquid tank 60 via the liquid circulation path 650 by the liquid driving pump 624 while dissolved gas is removed from the liquid inside the liquid circulation channel 650 by the deaerator 62 in the liquid circulation channel 650.

Thereupon, the input of image data is awaited (step S38), and printing is then carried out in accordance with the input of image data (step S40).

Each time printing is carried out, the ink temperature during the current use is measured by the temperature meter 72 (step S42). Each ink temperature during the current use thus measured is recorded in the memory 152 by the print controller 150 as a part of the temperature change history. The ink temperature increase (the differential between the current "maximum ink temperature during use" and the current "startup ink temperature") of the current operation may be registered and updated in step S42, or it may be registered when the operation of the inkjet recording apparatus 10 has completed.

In the present embodiment, the maximum value is extracted from the differential values (past ink temperature increases) between the ink temperatures (past startup ink temperatures) inside the common flow channel 55 of the liquid ejection head 50 at past startups of the inkjet recording apparatus 10 and the maximum ink temperatures (past maximum ink temperatures during use) inside the common flow channel 55 of the liquid ejection head 50 during use after the past startups of the inkjet recording apparatus 10. This maximum value (the maximum value of the past ink temperature increases) is added to the ink temperature (the current startup ink temperature) inside the liquid ejection head 50 at the current startup of the inkjet recording apparatus 10 to predict the maximum ink temperature (the maximum ink temperature during the current use) in the liquid ejection head that may occur during use after the current startup. The saturated amount of dissolved gas in the ink inside the common flow channel 55 of the liquid ejection head 50 is determined in accordance with the maximum ink temperature during the current use predicted above. Hence, the liability to form gas bubbles can be predicted reliably at startup of the inkjet recording apparatus 10 even if the ink temperature increase varies with the season in which the inkjet recording apparatus 10 is being used. For example, sudden temperature changes, such as winter conditions, can be predicted in advance and liquid restoration operations can be carried out appropriately. Consequently, formation of gas bubbles can be prevented in a reliable fashion.

The present invention is not limited to particular cases of this kind. For example, the print controller 150 may also determine the saturated amount of dissolved gas on the basis of the maximum temperature (for example, the maximum ink temperature during the past week) of the ink inside the common flow channel 55 of the liquid ejection head 50 during a prescribed period in the past (for example, the past week).

Furthermore, "startup" of the inkjet recording apparatus 10 is not limited to the switching on of the power supply. The "startup" may be the start of operation of the inkjet recording apparatus 10; for example, the time point of startup may be a time at which image data is input after a long idle period without printing, and the processing shown in the flowchart of FIG. 11 may also be carried out in such cases.

Second Embodiment

Figure 13:
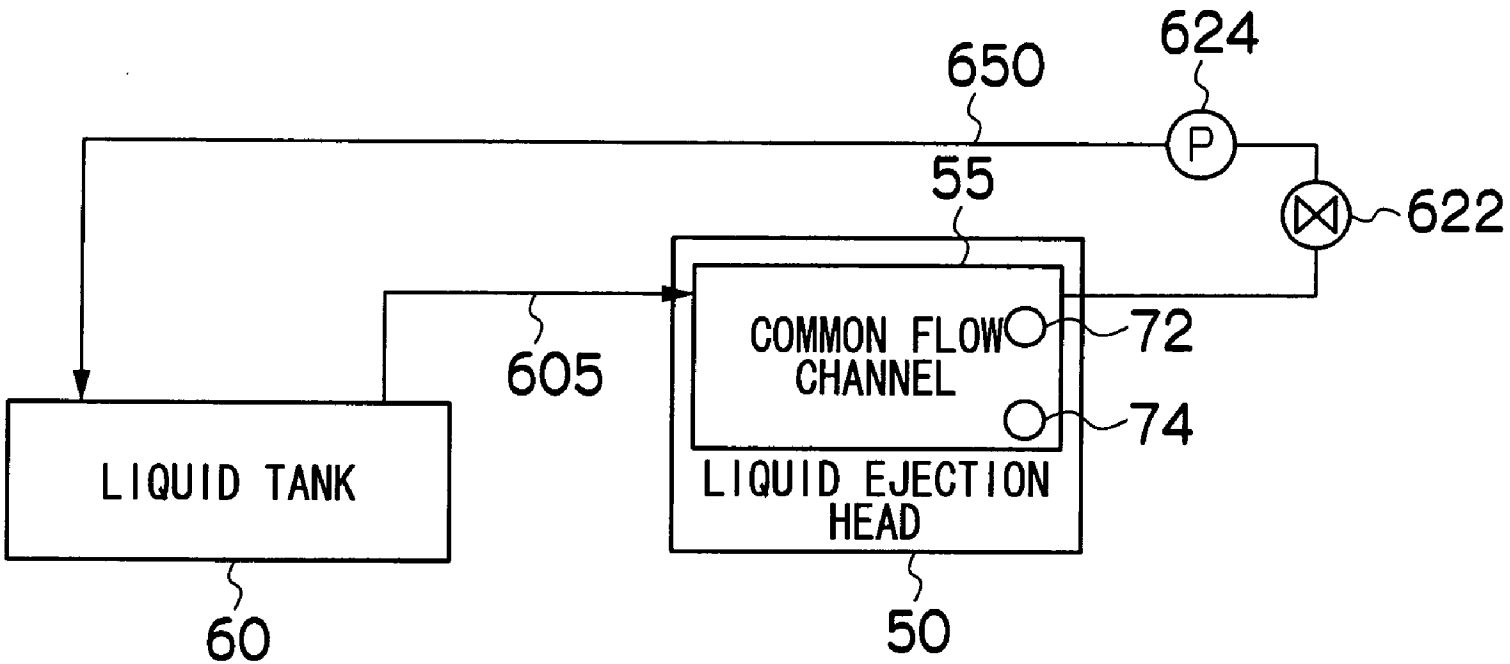
FIG. 13 is a block diagram showing the principal part of liquid restoration according to a second embodiment.

FIG. 13 is a block diagram showing the principal parts relating to the liquid restoration in the inkjet recording apparatus 10 according to a second embodiment of the present invention. In FIG. 13, the constituent elements which are described above with reference to the block diagram of the ink supply system shown in FIG. 5 are denoted with the same reference symbols, and the details described above are omitted. Furthermore, in FIG. 13, the direction indicated by the arrows is the direction in which the ink flows.

As shown in FIG. 13, in the present embodiment, a valve 622 and a liquid driving pump 624 are provided in the liquid circulation channel 650 leading from the liquid ejection head 50 to the liquid tank 60. In other words, the liquid tank 60, the liquid ejection head 50, the valve 622, and the liquid driving pump 624, are disposed in this order from the upstream side of the liquid supply channel 605 to the downstream side of the liquid circulation channel 650.

Furthermore, a temperature meter 72 serving as the liquid temperature measurement unit 172 shown in FIG. 6 and the dissolved oxygen meter 74 serving as the dissolved gas amount determination unit 174 shown in FIG. 6 are disposed inside the common flow channel 55 of the liquid ejection head 50.

The valve 622 opens and closes the liquid circulation channel 650. The liquid driving pump 624 sends the ink inside the common flow channel 55 of the liquid ejection head 50 to the liquid tank 60. The valve 622 and liquid driving pump 624 serve as the liquid restoration unit 162 shown in FIG. 6 and are controlled by the print controller 150 shown in FIG. 6.

When the liquid restoration process is carried out, the print controller 150 shown in FIG. 6 opens the valve 622 in the liquid circulation channel 650 and drives the liquid driving pump 624 so that the ink inside the common flow channel 55 of the liquid ejection head 50 is sent to the liquid tank 60 via the liquid circulation channel 650.

Desirably, the liquid tank 60 is a bag-shaped body (a plastic bag) having plasticity properties made of a highly airtight member which has been subjected to a processing, such as aluminum vapor deposition. Furthermore, desirably, the ink inside the liquid tank 60 is deaerated ink which has previously been deaerated.

For the liquid restoration processing of the inkjet recording apparatus 10 according to the second embodiment, it is possible to adopt the liquid restoration processing shown in FIG. 10 or the liquid restoration processing shown in FIG. 11.

In the inkjet recording apparatus 10 according to the second embodiment, during the liquid restoration processing (at step S16 in FIG. 10 or step S36 in FIG. 11), the valve 622 in the liquid circulation channel 650 is opened and ink inside the common flow channel 55 of the liquid ejection head 50 which has not been ejected is sent to the liquid tank 60 via the liquid circulation channel 650, by the liquid driving pump 624. In other words, the amount of dissolved gas per unit volume of the ink inside the liquid ejection head 50 is reduced by returning the ink which contains a large amount of dissolved gas inside the liquid ejection head 50, to the liquid tank 60 which has a large capacity.

FIG. 14 is a diagram showing the relationship between the gas dissolving capacity (A−B) of the ejection liquid, and the ejection state (gas bubble dissolution state) of the liquid ejection head 50 obtained on the basis of experimentation, when ink having a saturated amount "A" of dissolved oxygen of 7.0 mg/l at an ambient temperature of 25° C. is used.

In FIG. 14, ink having an amount "B" of dissolved oxygen of 3.5 mg/l was filled into the liquid ejection head 50 and the ejection state was observed, and more specifically, the ejection drive waveform was repeatedly given twice to each actuator 58 of the liquid ejection head 50 at the gas dissolving capacity of 3.5 mg/l (i.e., A−B=7.0−3.5=3.5 mg/l). In this case, the occurrence rate of nozzles suffering ejection failure was 0%. In other words, the ejection state (gas bubble dissolution state) was "good".

Ink having an amount "B" of dissolved oxygen of 5.5 mg/l was filled into the liquid ejection head 50 and the ejection state was observed, and more specifically, the ejection drive waveform was repeatedly given four times to each actuator 58 of the liquid ejection head 50 at the gas dissolving capacity of 1.5 mg/l (i.e., A−B=7.0−5.5=1.5 mg/l). In this case, the occurrence rate of nozzles suffering ejection failure was 0%. In other words, the ejection state (gas bubble dissolution state) was "good".

Moreover, ink having an amount "B" of dissolved oxygen of 6.5 mg/l was filled into the liquid ejection head 50 and the ejection state was observed, and more specifically, the ejection drive waveform was repeatedly given six times to each actuator 58 of the liquid ejection head 50 at the gas dissolving capacity of 0.5 mg/l (A−B=7.0−6.5=0.5 mg/l). In this case, the occurrence rate of nozzles suffering ejection failure was 5%. In other words, the ejection state (gas bubble dissolution state) was "poor".

Based on these experimental results, it was found that the ejection failure prevention effect is achieved when the gas dissolving capacity (A−B) is equal to or greater than 1.5 mg/l.

The first embodiment and the second embodiment described above relate to embodiments in which the liquid temperature inside the common flow channel 55 of the liquid ejection head 50 is measured by means of the temperature meter 72 disposed inside the common flow channel 55 of the liquid ejection head 50, but the present invention is not limited in particular to cases of this kind. It is also possible to measure the liquid temperature by means of a temperature meter disposed inside the liquid supply device which supplies liquid to the liquid ejection head 50. For example, the liquid temperature may be measured inside the liquid supply channel 605 shown in FIG. 5, in the vicinity of the liquid ejection head 50. Moreover, it is also possible to measure the temperature of the liquid ejection head 50 and treat this temperature as the liquid temperature. Furthermore, it is also possible to measure the temperature of the liquid supply device which supplies liquid to the liquid ejection head 50 and treat this temperature as the liquid temperature. For example, the temperature of the liquid supply channel 605 shown in FIG. 5 may be measured in the vicinity of the liquid ejection head 50.

The first embodiment and the second embodiment described above relate to cases in which the dissolved oxygen amount contained in the liquid inside the common flow channel 55 of the liquid ejection head 50 is measured by means of the dissolved oxygen meter 74 disposed inside the common flow channel 55 of the liquid ejection head 50. However, the present invention is not limited in particular to cases of this kind, and it is also possible to measure the amount of dissolved oxygen of the liquid by means of a dissolved oxygen meter disposed inside the liquid supply device which supplies liquid to the liquid ejection head 50. For example, the amount of dissolved oxygen may be measured inside the liquid supply channel 605 shown in FIG. 5, in the vicinity of the liquid ejection head 50.

Embodiments of the present invention are described in detail above, but the present invention is not limited to the embodiments described in the present specification, or the embodiments shown in the drawings, and it is possible for improvements or design modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection device which ejects liquid;

a liquid supply device which supplies the liquid to the liquid ejection device;

a saturated dissolved gas amount determination device which determines a saturated dissolved gas amount of the liquid in the liquid ejection device;

a dissolved gas amount determination device which determines a dissolved gas amount of the liquid in the liquid ejection device;

a liquid restoration device which carries out a liquid restoration processing to reduce the dissolved gas amount of the liquid inside the liquid ejection device; and a liquid restoration control device which controls whether or not the liquid restoration device carries out the liquid restoration processing, according to a differential between the saturated dissolved gas amount determined by the saturated dissolved gas amount determination device and the dissolved gas amount determined by the dissolved gas amount determination device.

2. The liquid ejection apparatus as defined in claim 1, wherein the saturated dissolved gas amount determination device determines the saturated dissolved gas amount according to at least one of a temperature of the liquid in the liquid ejection device, a temperature of the liquid in the liquid supply device, a temperature of the liquid ejection device, and a temperature of the liquid supply device.

3. The liquid ejection apparatus as defined in claim 1, wherein the dissolved gas amount determination device measures a dissolved gas amount of the liquid in one of the liquid ejection device and the liquid supply device, and determines the dissolved gas amount of the liquid in the liquid ejection device according to the measured dissolved gas amount of the liquid.

4. The liquid ejection apparatus as defined in claim 1, wherein the saturated dissolved gas amount determination device determines the saturated dissolved gas amount according to both of a pressure and a temperature of the liquid in the liquid ejection device.

5. The liquid ejection apparatus as defined in claim 1, wherein the saturated dissolved gas amount determination device:

estimates a maximum temperature of the liquid in the liquid ejection device which may occur during subsequent use, according to a temperature change history relating to the liquid in the liquid ejection device within a prescribed time period which has passed; and determines the saturated dissolved gas amount according to the maximum temperature of the liquid in the liquid ejection device.

6. The liquid ejection apparatus as defined in claim 5, wherein the saturated dissolved gas amount determination device:

selects a maximum differential from temperature differentials between temperatures of the liquid in the liquid ejection device at past startups of the liquid ejection apparatus and maximum temperatures of the liquid in the liquid ejection device during use after the past startups;

estimates a maximum temperature of the liquid in the liquid ejection device which may occur during use after a current startup by adding the maximum differential to a temperature of the liquid in the liquid ejection device at the current startup of the liquid ejection apparatus; and determines the saturated dissolved gas amount according to the estimated maximum temperature of the liquid in the liquid ejection device.

7. The liquid ejection apparatus as defined in claim 5, wherein the saturated dissolved gas amount determination device determines the saturated dissolved gas amount according to a maximum temperature of the liquid in the liquid ejection device during the prescribed time period which has passed.

8. The liquid ejection apparatus as defined in claim 5, wherein the liquid restoration control device controls the liquid restoration device in such a manner that the liquid restoration device carries out the liquid restoration processing if the differential between the saturated dissolved gas amount and the dissolved gas amount at a startup of the liquid ejection apparatus is less than a prescribed value.

9. The liquid ejection apparatus as defined in claim 1, further comprising:

a liquid circulation channel which is provided between the liquid ejection device and the liquid supply device, and leads the liquid in the liquid ejection device which has not been ejected, to the liquid supply device; and a liquid sending device which is provided in the liquid circulation channel, and sends the liquid in the liquid ejection device to the liquid supply device, wherein the liquid restoration control device controls the liquid sending device in such a manner that the liquid sending device sends the liquid in the liquid ejection device to the liquid supply device if the differential between the saturated dissolved gas amount and the dissolved gas amount is less than a prescribed value.

10. The liquid ejection apparatus as defined in claim 1, further comprising:

a liquid circulation channel which is provided between the liquid ejection device and the liquid supply device, and leads the liquid in the liquid ejection device which has not been ejected, to the liquid supply device; and a deaerator which is provided in the liquid circulation channel, and removes dissolved gas from the liquid in the liquid circulation channel, wherein the liquid restoration control device controls the deaerator in such a manner that the deaerator removes the dissolved gas from the liquid in the liquid circulation channel if the differential between the saturated dissolved gas amount and the dissolved gas amount is less than a prescribed value.

11. A liquid restoration method for restoring a state of liquid in a liquid ejection device, the liquid restoration method comprising the steps of:

determining a saturated dissolved gas amount of the liquid in the liquid ejection device;

determining a dissolved gas amount of the liquid in the liquid ejection device;

conducting judgment of whether or not to carry out a liquid restoration processing for reducing the dissolved gas amount of the liquid, according to a differential between the saturated dissolved gas amount and the dissolved gas amount; and carrying out the liquid restoration processing in accordance with result of the conducted judgment.

12. The liquid restoration method as defined in claim 11, further comprising the step of obtaining a temperature of the liquid in the liquid ejection device, wherein the saturated dissolved gas amount is determined according to the temperature of the liquid in the liquid ejection device.

13. The liquid restoration method as defined in claim 11, further comprising the step of estimating a maximum temperature of the liquid in the liquid ejection device which may occur during subsequent use, according to a temperature change history relating to the liquid in the liquid ejection device within a prescribed time period which has passed, wherein the saturated dissolved gas amount is determined according to the maximum temperature of the liquid.

* * * * *